US005159162A

United States Patent [19]

Tatino

[11] Patent Number: 5,159,162

[45] Date of Patent: Oct. 27, 1992

[54] ELEVATOR LEVELING CONTROL DEVICE

[75] Inventor: Kenzo Tatino, Inazawa, Japan

[73] Assignee: Mitsubishi Denki Kabushiki Kaisha, Japan

[21] Appl. No.: 717,065

[22] Filed: Jun. 18, 1991

[30] Foreign Application Priority Data

Jun. 22, 1990 [JP] Japan ..... 2-162815

[51] Int. Cl.[5] ..... B66C 1/28

[52] U.S. Cl. ..... 187/116; 187/115

[58] Field of Search ..... 187/105, 113, 115

[56] References Cited

U.S. PATENT DOCUMENTS 4,042,068 8/1977 Ostrander et al. ..... 187/115
4,337,846 7/1982 Yonemoto et al. ..... 187/113
4,494,628 1/1985 Uherek et al. ..... 187/113
4,785,914 11/1988 Blain et al. ..... 187/105

FOREIGN PATENT DOCUMENTS 2024798 5/1981 Fed. Rep. of Germany .
4512609 5/1970 Japan .
1288583 11/1989 Japan .

*Primary Examiner*—A. D. Pellinen
*Assistant Examiner*—Lawrence E. Colbert
*Attorney, Agent, or Firm*—Leydig, Voit & Mayer

[57] ABSTRACT

An elevator control device includes an operation control device for controlling the speed of a car by a regular-speed command when the car is in a normal operation, and the operation control device generates a readjusting-speed command for retaining the car in a predetermined range when a stop position of the car at rest deviates from the predetermined range. The elevator control device also includes a readjusting-speed command reducing device for reducing a readjusting-speed command value to zero at a predetermined rate while an opened door of the car is closing, and switching device for switching to a regular-speed command from a readjusting-speed command when the door of the car is completely closed.

10 Claims, 3 Drawing Sheets

ELEVATOR LEVELING CONTROL DEVICE

BACKGROUND OF THE INVENTION

1. FIELD OF THE INVENTION

The present invention relates to an elevator control device. More particularly, it relates to an elevator control device which corrects deviations at the stop position attributable to variations in the stretching of a cable. These variations are caused by factors, such as a change in the load acting on a car when passengers get in and out of an elevator.

2. DESCRIPTION OF THE RELATED ART

Generally, elevators require precise level control functions. A leveling control controls the a stop position of an elevator so that the difference in the levels of the floor of the car at rest and a hall floor can be minimized as much as possible.

In elevators at high floors, the load acting on the car while the elevator is at rest may vary because passengers get in and out, or goods are loaded and unloaded. This variation causes a change in the stretching of a suspending cable. The level of the car may deviate considerably.

In such an elevator, the stretch of the rope has hitherto been compensated, and the leveling control mentioned above is performed. The leveling control is performed at a slow speed while the door is opened for passengers to get in and out of the car so that they do not feel uneasy. The compensation for the stretching of the cable, together with the leveling control, is hereinafter referred to as a readjusting control.

Because the readjusting control is performed while the door is open, it is stopped once a control for closing the door is performed. The completion of the operation of a door timer is one of the conditions under which the door is closed. The door timer sets the amount of time during which the door is open. When such a condition is met, a door-open command is made inoperable, thus causing the door to begin closing.

Therefore, even while the readjusting control is ongoing, if the operation of the above door timer is completed, making the door-open command inoperable, the readjusting control is terminated. The car stops before it reaches the level of the hall floor, with the result that the difference in the levels of the hall floor and the elevator may not be corrected.

Since the readjusting control is stopped, vibrations occur when the car is at rest, thereby making the passengers feel uneasy.

To cope with such a problem, Japanese Patent Laid-Open No. 1-288583 discloses a device provided with a means to retain a door-open command, thereby permitting the continuation of the readjusting control, even when the elevator enters into a mode in which the completion of the door timer makes the door-open command inoperable. In the above device, the level of the car deviates because passengers get in and out, or goods are loaded and unloaded. Therefore, during the readjusting control, even after the operation of the door timer has been completed and the elevator enters into a mode for closing the door, the readjusting control is performed until the level of the elevator reaches a predetermined value. However, when the door must be closed, closing of the door may be delayed during the readjusting control. This is a problem because it decreases the operational efficiency.

SUMMARY OF THE INVENTION

The present invention has been made in order to solve such a problem. Accordingly, a primary object of the invention is to provide an elevator control device which does not decrease the operational efficiency and which minimizes vibrations or other nuisance factors caused by the termination of a readjusting control when the door starts to close, which makes passengers feel uneasy.

In order to achieve the above object, according to the present invention, there is provided an elevator control device comprising: operation control means for controlling the speed of a car by a regular-speed command when the car is in a normal operation, the operation mode control means generating a readjusting-speed command for retaining the car in a predetermined position range when a stop position of the car is outside of the predetermined range; readjusting-speed command reducing means for reducing a readjusting-speed command value to zero at a predetermined rate when an opened door of the car is closed; and switching means for switching to a regular-speed command from a readjusting-speed command when the door of the car is completely closed.

DESCRIPTION OF THE PREFERRED EMBODIMENTS

The embodiments of the present invention will be described below with reference to the accompanying drawings.

Figure 1:
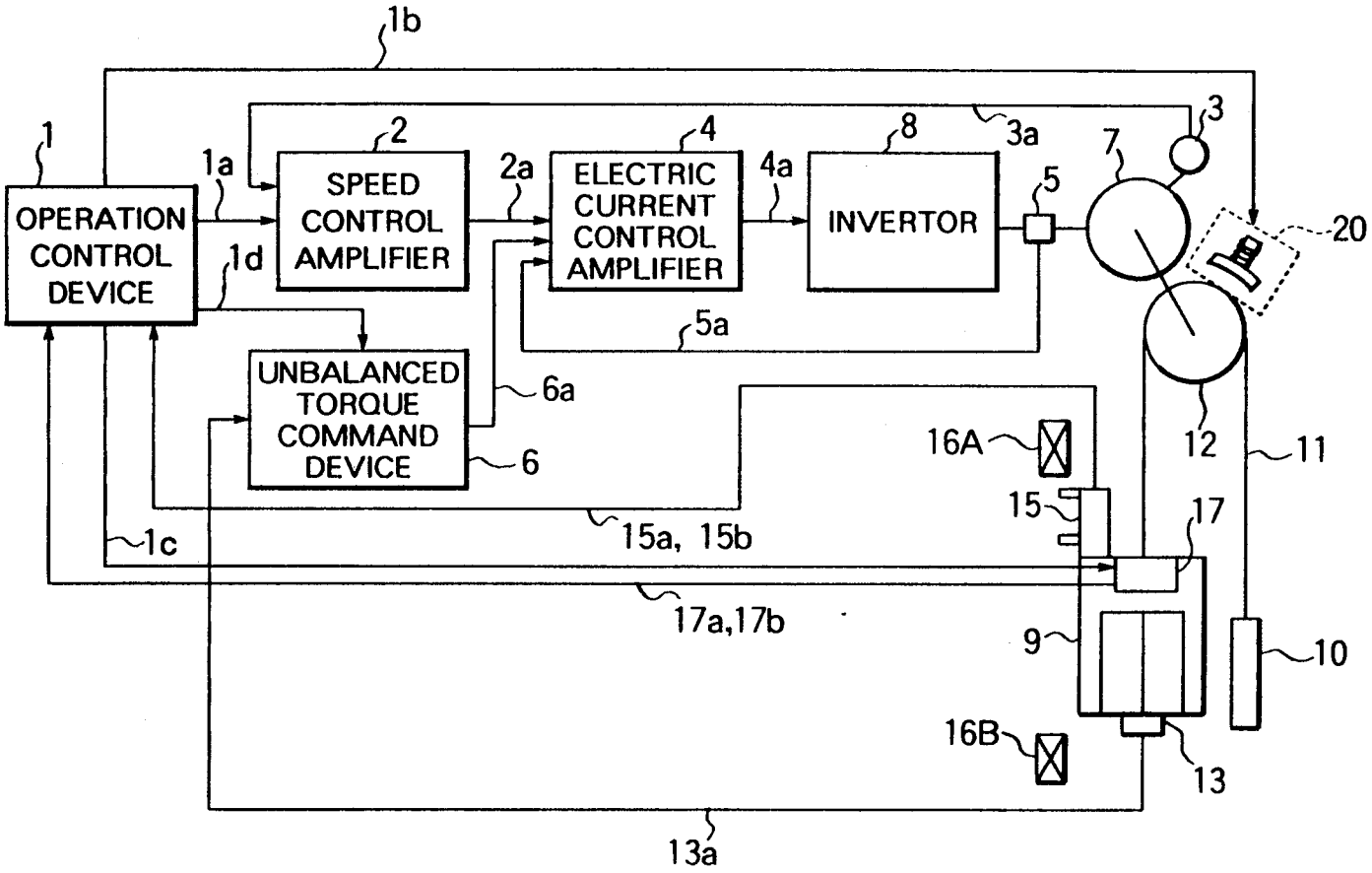
FIG. 1 is a block diagram showing an elevator control device in accordance with an embodiment.

In FIG. 1, numeral 1 denotes a control device for the operation of an elevator (hereinafter referred to as an operation control device) which outputs a speed command signal 1*a* to a speed control amplifier 2. The speed control amplifier 2 performs a comparison computation between the speed command signal 1*a* and a speed signal 3*a* sent from a speed detector 3. It then outputs an electric current command 2*a* to an electric current control amplifier 4. The electric current control amplifier 4 inputs the electric current command 2*a*, an electric current signal 5*a* sent from an electric current detector 5, and a load signal 6*a* transmitted from an unbalanced torque command device 6. The electric current control amplifier 4 then outputs a control signal 4*a* to an invertor 8. The invertor 8 supplies an AC motor 7 with AC power so as to control the AC motor 7 based on the control signal 4*a*. The AC motor 7 transmits its rotation to a sheave 12 over which a main rope 11 for connecting a car 9 to a counterweight 10 is fitted. Numeral 13 denotes a load detector attached to the car 9. The load detector 13 feeds a load detection signal 13*a* to the unbalanced torque command device 6 which generates a load signal 6*a* for correcting the amount of an unbalanced torque made between the car 9 and the counterweight 10. This load signal 6*a* is generated according to a balance control signal 1*d* sent from the operational control device 1. Numeral 15 denotes a position detector affixed to the car 9. The position detector 15 is disposed such that if faces two bodies 16A and 16B to be detected on each floor in the hoistway. This facing relationship allows the position detector 15 to generate a distance signal 15*a* and a zone signal 15*b* in accordance with the difference in the levels between each floor and the floor of the car 9. The distance signal 15*a* is transmitted to the operation control device 1, and is used for generating the speed command signal 1*a*. The zone signal 15*b* is transmitted when the distance between a given floor and the floor of the car 9 is within a distance in which the elevator must be readjusted to become level with the floor. The zone signal 15 is transmitted, for instance, when such a distance is between 10 mm and 75 mm and the elevator can be safely readjusted to become level with the floor. Numeral 17 denotes a door control device which receives a door open/close command 1*c* from the operation control device 1 in order to control the opening and closing of the door. The door control device 17 outputs a half-closed door signal 17*a* and a completely-closed-door signal 17*b* to the operation control device 1. The half-closed door signal 17*a* indicates that the door is closed more than a predetermined value, whereas the completely-closed-door signal 17*b* indicates that the door is completely closed. Numeral 20 denotes a brake which is controlled by a brake open/close command 1*b* sent from the operation control device 1.

Figure 2:
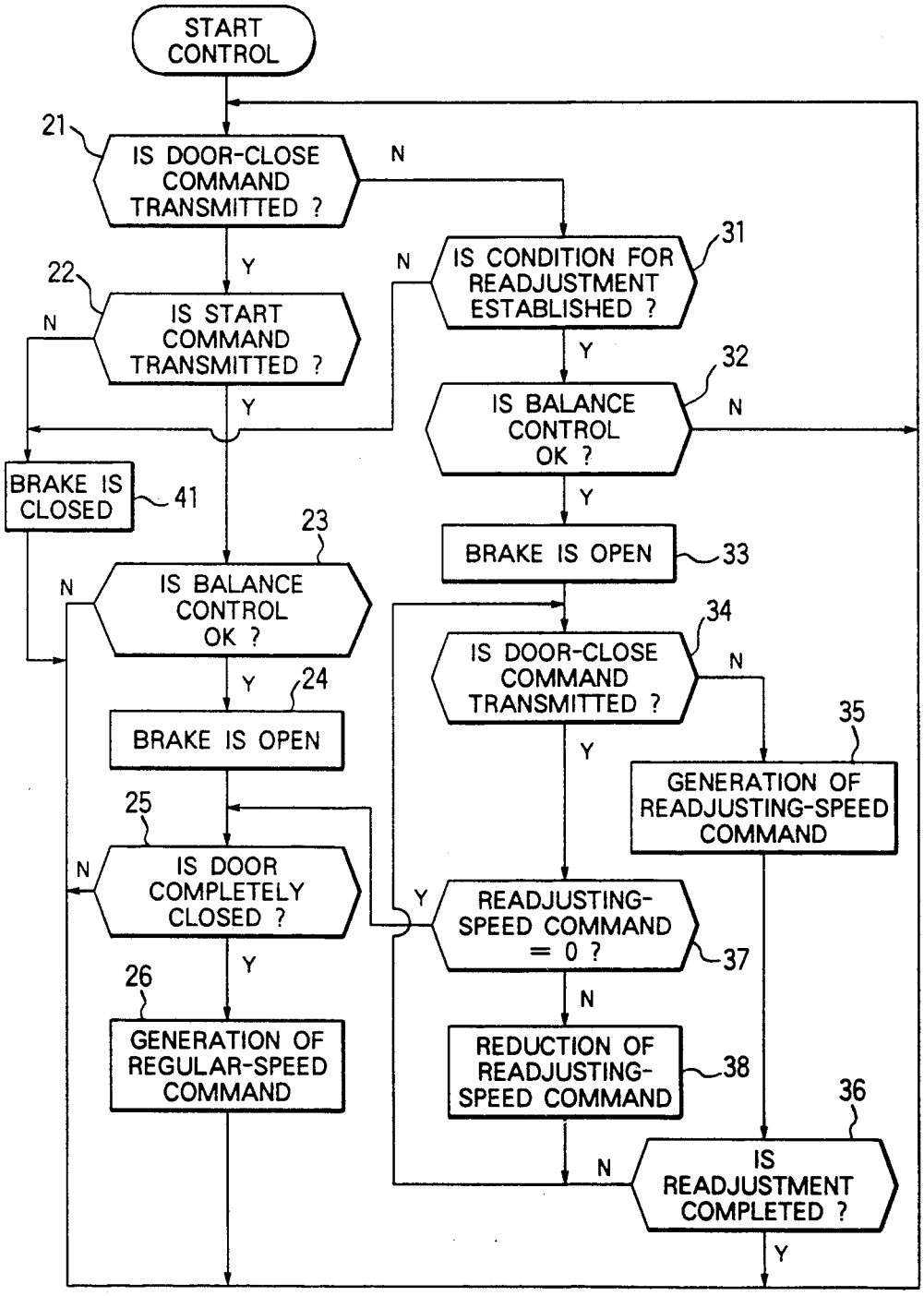
FIG. 2 is a flowchart showing the operation of the embodiment.

The operation of this embodiment will now be explained with reference to the flowchart of FIG. 2. At the start of a normal operation, a determination is made whether a door-close command is transmitted in step 21, and whether a start command is transmitted in step 22. Thereafter, in step 23, the balance control signal 1*d* is output from the operation control device 1. The balance control signal 1*d* is used for the unbalanced torque command device 6 to output the load signal 6*a* which corrects the amount of an unbalanced torque. A determination is made in step 23 that time has elapsed which is required for the AC motor 7 to obtain a torque sufficient for coping with the output of the balance control signal 1*d*. After it is determined that sufficient torque has been obtained, thus making it possible to control the balance between the car 9 and the counterweight 10, the operation control device 1 generates the brake-open command 1*b* in step 24. The brake 20 is thereby opened. Thereafter, in step 25, the completely-closed-door signal 17*b* is detected so as to confirm that the door is completely closed. If the door is completely closed, the operation control device 1 generates the speed command signal 1*a* in step 26. The car 9 thereby begins operating until it reaches its destined floor.

In step 21, if the door-close command is not transmitted, the logical flow of the flowchart proceeds to step 31. In step 31, a determination is made whether a condition for readjusting the elevator to become level with a given floor is established. That is, when the zone signal 15*b*, transmitted from the position detector 15, is first detected, and when the difference in the levels of the floor and the floor of the car 9 is, for example, between 10 mm and 75 mm, then a determination is made that the condition for readjustment is established. The logical flow then proceeds to step 32. In step 31, on the contrary, when the difference between the given floor and the floor of the car 9 is less than 10 mm or more than 75 mm, a determination is made that the condition for readjustment is not established. The logical flow proceeds to step 41. In step 32, as in step 23, a determination is made whether the balance between the car 9 and the counterweight 10 can be controlled. If a determination is made that the balance can be controlled, the operation control device 1 generates the brake-open command 1*b* in step 33. The brake 20 is thereby opened.

Thereafter, in step 34, a determination is made whether the door-close command is transmitted. If the door-close command is not transmitted, the operation control device 1 outputs a readjusting-speed command in the form of the speed command signal 1*a* in step 35. This readjusting-speed command corresponds to the distance signal 15*a* sent from the position detector 15. In step 36, a determination is made whether a readjustment has been completed. If the readjustment has not been completed, the logical flow returns to step 34. In this way, unless the door-close command is transmitted, steps 34 to 36 are repeated until the readjustment is completed.

When the difference in the levels of the floor and the floor of the car 9 becomes 10 mm or less, a determination is made that the readjustment has been completed in step 36. The logical flow then returns to step 21. At this point, when the door-close command is not transmitted, the logical flow proceeds from step 21 to step 41 through step 31. The operation control device 1 transmits the speed command signal 1*a* which commands the speed of the car 9 to be zero. The invertor 8 is thereby interrupted, and the brake-close command 1*b* is transmitted to close the brake 20, thus stopping the car 9. In step 21, on the contrary, if the door-close command is transmitted, a determination is made whether the start command is transmitted in step 22. If the start command is not transmitted, the logical flow proceeds to step 41 in which the brake is applied. In step 22, on the contrary, if the start command is transmitted, the logical flow proceeds to step 25 through steps 23 and 24. In step 25, if a determination is made that the door is completely closed, the operation control device 1 generates a regular-speed command in the form of the speed command signal 1*a* in step 26. The speed command signal 1*a* allows the car 9 to start operating.

When the door-close command is transmitted while a readjustment operation is performed, the logical flow proceeds from step 34 to step 37, in which a determination is made whether a speed command value of the readjustment is zero. If the speed command value of the readjustment is not zero, the logical flow proceeds to step 38 in which the speed command value is reduced at a preset reducing rate, regardless of the distance signal 15*a*. Steps 34, 37 and 38 are repeated until a determination is made that the speed command value becomes zero.

When the speed command value becomes zero in this way, the logical flow proceeds from step 37 to step 25. In step 25, if a confirmation is made that the door is completely closed, the operation control device 1 generates the regular-speed command in the form of the speed command signal 1*a* in step 26. The speed command signal 1*a* permits the car 9 to begin moving to its destined floor. In step 25, on the other hand, if a confirmation is made that the door is not completely closed, steps 21 to 25 are repeated. The speed command value and the output (torque command) from the unbalanced torque command device 6 continue to maintain the car 9 at its level. As soon as a confirmation is made that the door is completely closed, the car 9 becomes ready for beginning its operation. In such a case, even if the brake 20 is opened and the load acting on the car 9 varies, the car 9 will not move, and therefore the passengers inside are safe. This is because the car 9 is maintained at its level by the speed command value and the torque command.

Figure 3:
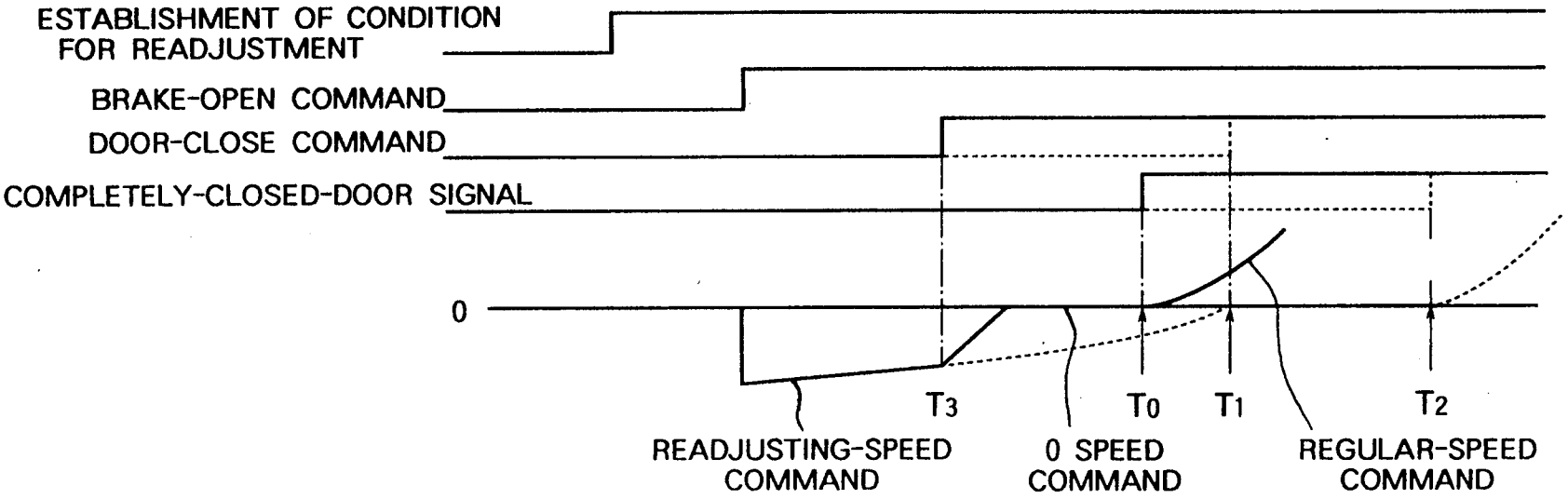
FIG. 3 is view showing the operational timing in the embodiment.

FIG. 3 shows the operational timing in this embodiment. As indicated by the broken lines in FIG. 3, in the conventional art, the door-close command is not accepted until a time $T_1$ at which a readjustment is completed. The readjusting-speed command is then switched to the regular-speed command at a time $T_2$ at which the door is completely closed. In this embodiment, however, after the door-close command is detected at time $T_3$, the readjusting-speed command is reduced to zero at a predetermined rate. When it is detected that the door is completely closed by the completely-closed-door signal 17*b* at time $T_0$, the readjusting-speed command is switched to the regular-speed command. Therefore, in this embodiment, the regular-speed command is generated earlier than in the conventional art. The operational efficiency of the elevator will thus be improved.

As another embodiment, in step 34, instead of confirming whether the door-close command is transmitted, a confirmation is made whether the half-closed door signal 17*a* from the door control device 17 is detected. If the half-closed door signal 17*a* is detected, the logical flow may proceed to step 37. If, on the other hand, it is not detected, the logical flow may proceed to step 35. For example, when the door is opened about 40 mm and passengers cannot get in or out of the car, the logical flow proceeds to steps 37 and 38, in which the readjusting-speed command value is reduced. In this case, in step 38 the readjusting-speed command value is set so as to be reduced to zero by the time that the door is completely closed. In this arrangement, it is possible to prevent the uncomfortable feeling caused by vibrations attributable to a sudden change in the speed command from the readjusting-speed command to the regular-speed command. In addition, even when the door-close command is transmitted, the elevator can continue to readjust itself while passengers get in and out of the elevator. Such readjustment will not reduce the operational efficiency of the elevator.

What is claimed is:

1. An elevator control device comprising:

operation control means for controlling the speed of a car by a regular-speed command when the car is in a normal operation, the operation control means generating a readjusting-speed command for readjusting a position of the car retaining the car in a predetermined range of a stop position;

readjusting-speed command reducing means for reducing a readjusting-speed command value to zero at a predetermined rate while an opened door of the car is closing; and switching means for switching to a regular-speed command from a readjusting-speed command when the door of the car is completely closed.

2. An elevator control device as claimed in claim 1 further comprising a door control means for controlling the opening and closing of the door based on a command from said operation control means, said door control means detecting a distance at which the door is open.

3. An elevator control device as claimed in claim 2 wherein said readjusting-speed command reducing means reduces the readjusting-speed command value when it is detected that a door-close command is transmitted from said operation control means to said door control means.

4. An elevator control device as claimed in claim 2 wherein said readjusting-speed command reducing means reduces the readjusting-speed command value when it is detected that said door control means closes the door to a predetermined position.

5. An elevator control device as claimed in claim 4 wherein said readjusting-speed command reducing means reduces the readjusting-speed command value with a reduction rate so that the readjusting-speed command value is reduced to zero by the time that the door is completely closed.

6. An elevator control device as claimed in claim 1 further comprising:

a torque command generating means for generating a torque command which corrects the amount of unbalance torque made between the car and a counterweight; and a car retaining means for retaining the position of the car by a torque command generated by said torque command generating means and the readjusting-speed command generated by said operation control means for at least a period from the time at which said operation control means generates a readjusting-speed command till the time at which it is detected that said door control means has completely closed the door.

7. An elevator control device comprising:

operation control means for controlling the speed of a car by a regular-speed command when the car is in a normal operation mode, said operation control means generating a readjusting-speed command for readjusting a position of the car within a predetermined range about a stop position; and readjusting-speed command reducing means for reducing a readjusting-speed command value to zero at a predetermined rate while an opened door of the car is closing thus reducing the time at which the car is at rest.

8. An elevator control device as claimed in claim 7 further comprising switching means for switching from the readjusting-speed command to the regular-speed command when the door is completely closed.

9. A method of releveling an elevator car comprising the steps of:

stopping a car at a selected position proximate to a target floor;

returning the car to the selected position at a readjusting-speed after the car has drifted from the selected position; and reducing the readjusting speed when car doors begin to close such that the readjusting-speed becomes zero before the car doors are completely closed.

10. A method of releveling an elevator car as claimed in claim 9 further comprising the step of moving the car to another floor at normal speed when the doors are completely closed.

* * * * *